United States Patent [19]

Szostak et al.

[11] 4,434,736

[45] Mar. 6, 1984

[54] STRAIN CONTROLLED SEWING MACHINE MOUNT

[75] Inventors: Jan Szostak, Lincroft; Albert L. Newman, West Orange, both of N.J.

[73] Assignee: The Singer Company, Stamford, Conn.

[21] Appl. No.: 458,425

[22] Filed: Jan. 17, 1983

[51] Int. Cl.[3] ..... D05B 75/00

[52] U.S. Cl. ..... 112/258; 411/165; 411/368; 411/435; 411/7; 403/407

[58] Field of Search ..... 403/407, 408; 411/378, 411/427, 368, 544, 165, 153, 435, 7; 248/678; 112/258

[56] References Cited

U.S. PATENT DOCUMENTS 2,165,656 7/1939 Ryan .
3,238,543 3/1966 Hopp et al. ..... 411/165 X
3,267,792 8/1966 Yackle .
3,273,443 9/1966 Rubin .
3,280,689 10/1966 Rubin .
4,211,178 7/1980 Peterson .
4,275,939 6/1981 Odermann .
4,376,332 3/1983 Sandefur ..... 403/408 X

FOREIGN PATENT DOCUMENTS 564452 6/1957 Italy ..... 403/408

*Primary Examiner*—Werner H. Schroeder
*Assistant Examiner*—Andrew M. Falik
*Attorney, Agent, or Firm*—William V. Ebs; Robert E. Smith; Edward L. Bell

[57] ABSTRACT

A sewing machine is secured to the platform of a sewing cabinet with a machine connected stud and a wing nut which is threaded on the stud and is permitted to turn only a limited amount so as to prevent excessive force from being applied to the machine.

7 Claims, 3 Drawing Figures

STRAIN CONTROLLED SEWING MACHINE MOUNT

DESCRIPTION

Background of the Invention

1. Field of the Invention

The invention relates to sewing machine cabinets and more particularly, to means for securing a sewing machine to a platform in a cabinet.

2. Description of the Prior Art

It is well known to attach a sewing machine to a platform in a cabinet wherein the machine can be moved with the platform between a position suitable for sewing and a stowed position. Commonly a machine has been secured to a platform in a sewing cabinet with devices capable of applying hold down forces to the machine far in excess of what was required to assure a fixed position for the machine on the platform. U.S. Pat. No. 4,275,939 of Charles R. Odermann, issued June 30, 1981, shows one such device including an upper end formed to hook into the bed of a machine, and a lower threaded end to extend through the platform and have a nut tightened thereon to draw the machine down against a supporting platform.

If excessive force is applied to a machine with a hold down device, distortion or other damage to the frame of the machine may ensue, and is especially likely to occur if the frame is of a reinforced plastic material. A plastic frame may be warped to such an extent as to prevent the proper operation of movable parts supported thereon.

It is a prime object of the present invention to provide the means for positively securing a sewing machine to a supporting platform in a cabinet without subjecting the frame of the machine to excessive stress causing damage thereto.

It is another object of the invention to limit the force which can be applied to a sewing machine with a hold down device used to secure the machine to a supporting platform on a sewing cabinet.

Other objects and advantages of the invention will become apparent during a reading of the specification taken in connection with the accompanying drawings.

SUMMARY OF THE INVENTION

A stud is detachably connected to a sewing machine in a recess in the base of the machine. The machine is secured to a supporting platform in a sewing cabinet with a wing nut which is tightened upon a threaded end portion of the stud caused to extend through a hole in the platform to the underside thereof. A coil spring and pronged washer are provided between the wing nut and bottom surface of the platform. The coil spring is compressed by the wing nut and the washer is forced by the spring against the platform as the wing nut is tightened on the stud. Upwardly extending prongs on the washer dig into the platform to prevent the washer from turning, and the engagement of downwardly extending prongs on the washer with the wing nut limits the extend to which the nut can be tightened on the stud and so prevents excessive downward force from being applied to the frame of the machine.

DESCRIPTION OF THE PREFERRED EMBODIMENT

Figure 1:
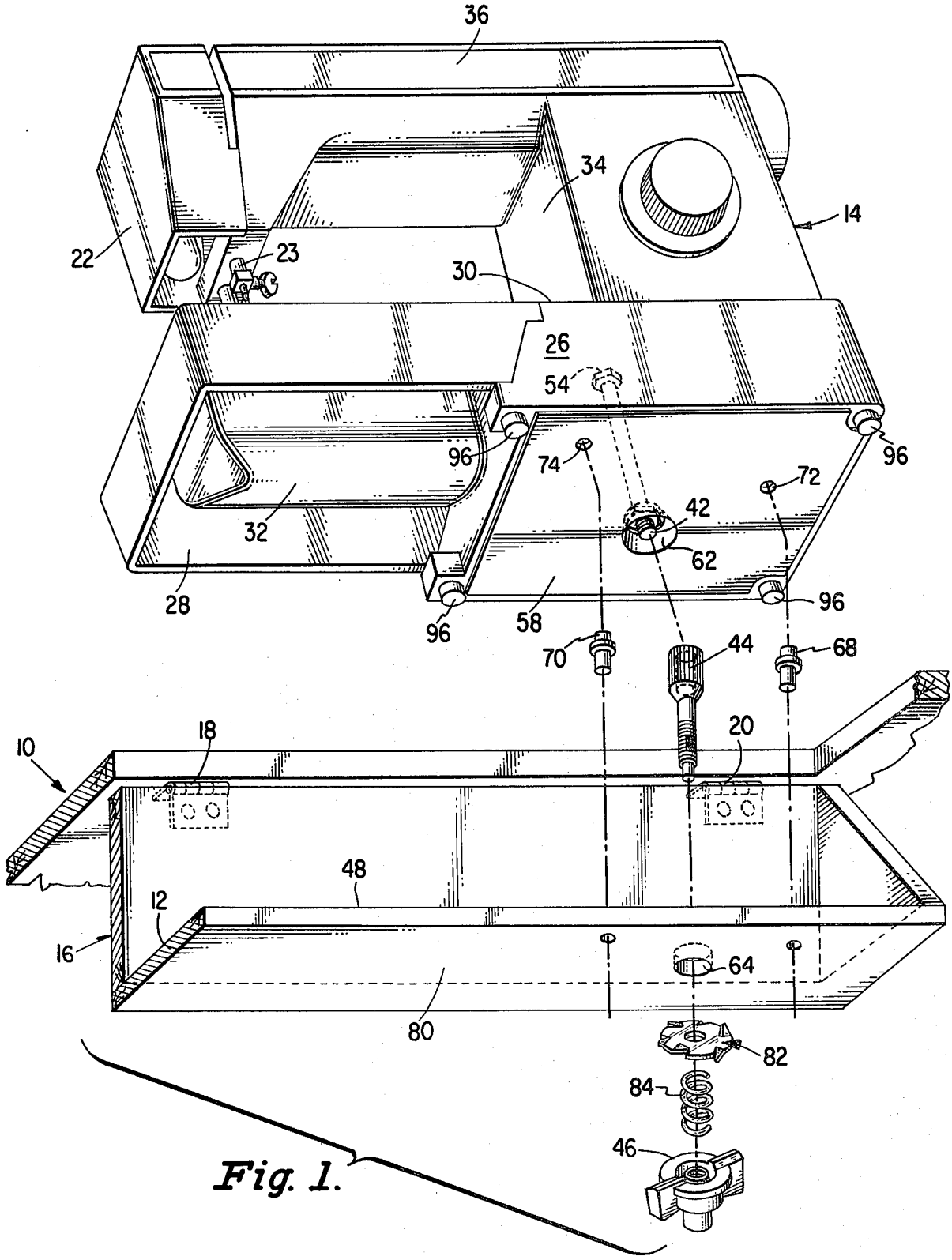
FIG. 1 is a perspective view showing a sewing cabinet platform, a sewing machine, and hold down means according to the invention for securing the machine to the platform.

Referring to FIG. 1 of the drawings, there may be seen a portion of a typical sewing machine cabinet 10 including a platform 12 for a sewing machine 14 on a foldable shelf 16 which is hinged in the cabinet at 18 and 20. As shown, the sewing machine includes a head end portion 22 wherein a needle bar 23 is supported for endwise reciprocation, a base 26 with an extension 28 thereon for enlarging a work supporting surface 30 to that required for flat bed sewing as distinguished from free arm sewing done with the extension removed from arm 32, a standard 34 which rises from the bed, and a bracket arm 36 that extends from the standard to connect with and support the head end portion 22 of the machine.

Figure 2:
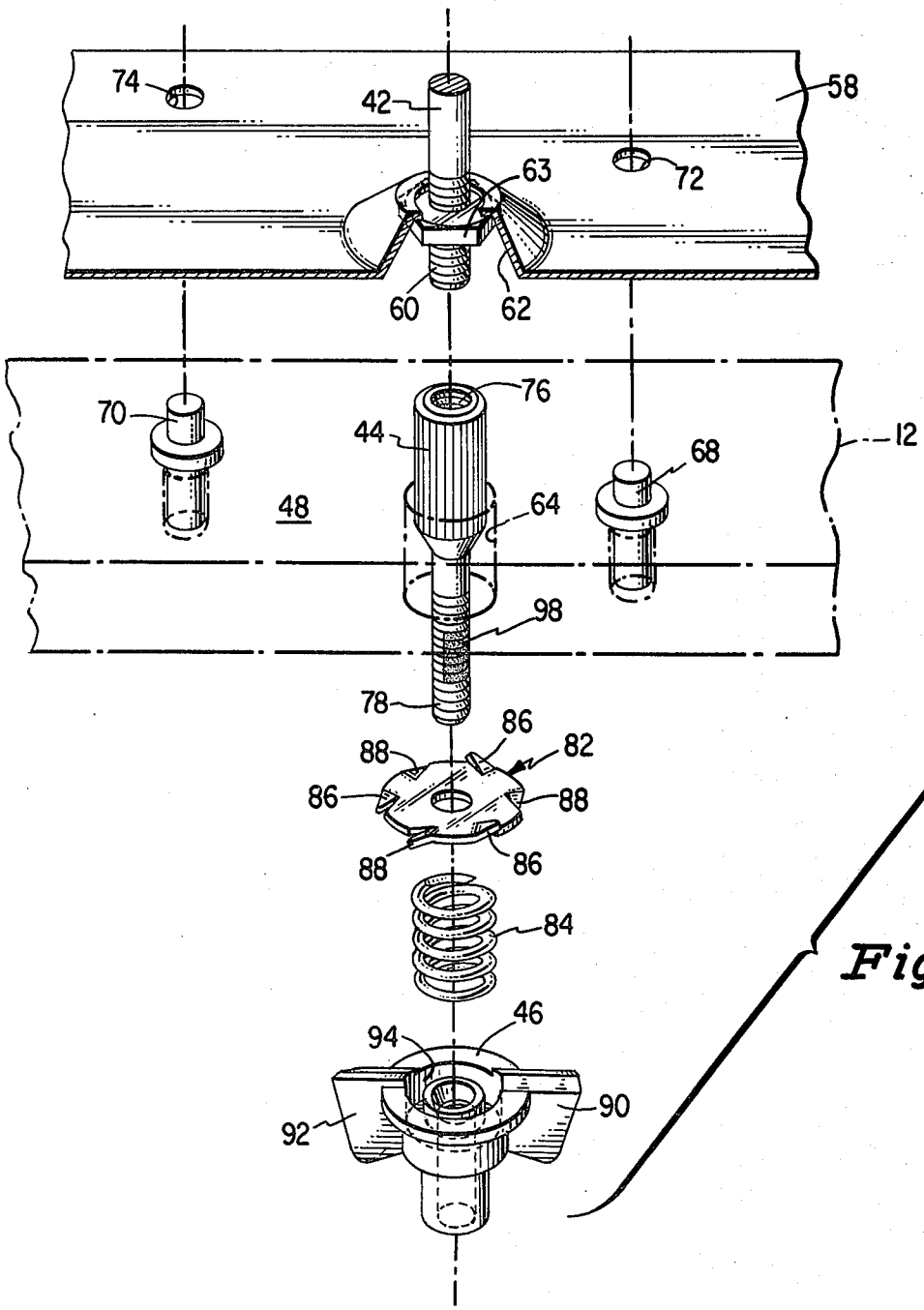
FIG. 2 is an enlarged expolded perspective view showing details of the hold down means.
Figure 3:
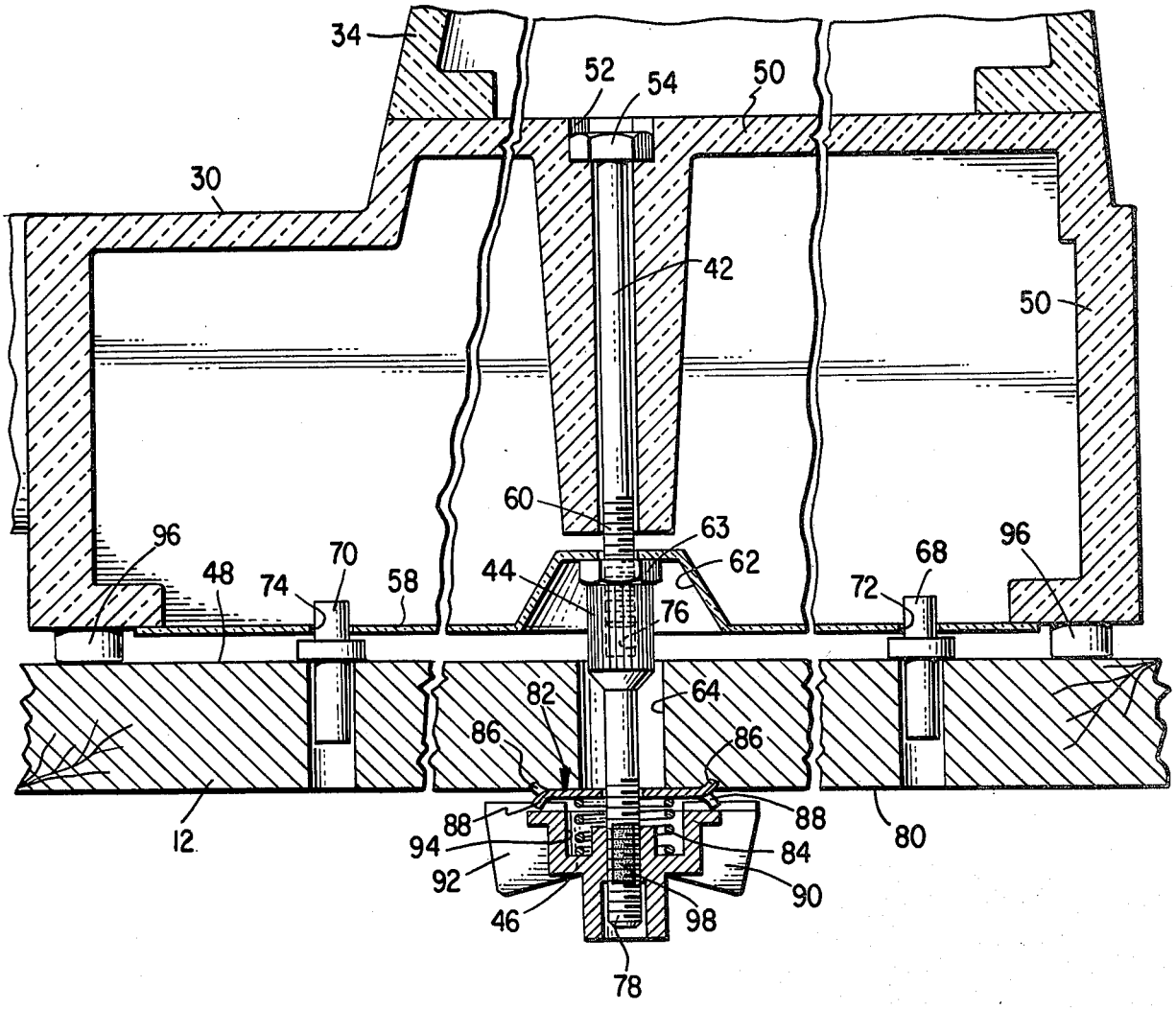
FIG. 3 is a longitudinal vertical sectional view taken through the base of the machine and hold down means.

Sewing machine 14 is secured to platform 12 with threaded studs 42 and 44 in association with a wing nut 46 which is tightened on stud 44 to draw the machine down onto the upper surface 48 of the platform (FIGS. 1, 2 and 3). As will be explained hereinafter, the wing nut can be tightened to only a limited extent on stud 44 and is therefor prevented from causing excessive force to be applied to the machine such as might result in damage to the structure.

Stud 42 extends downwadly in the supporting frame 50 of the machine from a hexagonal well 52 wherein a correspondingly shaped head end 54 of the stud is located to prevent the stud from turning in the frame. The stud passes through a bottom cover 58 to project a threaded end 60 into a bottom cover recess 62 wherein the stud is secured with a nut 63. Before machine 14 is attached to platform 12, stud 42 is aligned with a through opening 64 in the platform by disposing machine 14 in a position on platform 12 wherein pins 68 and 70 affixed in the platform register in holes 72 and 74, respectively in the bottom cover 58. The second stud 44 which is formed with a threaded socket 76 at one end is then inserted upwardly through opening 64 in the platform with the socket end first, and connected to stud 42 by screwing the threaded socket onto threaded end 60 of stud 42. A threaded end portion 78 of connected stud 44 extends below the bottom surface 80 of platform 12 as shown.

A pronged washer 82 and a coil spring 84 are threaded onto stud 44 with the washer over the coil spring, after which wing nut 46 is screwed onto threaded end portion 78 of the stud. The washer is formed with upwardly extending prongs 86 which are engageable with the underside of platform 12 and with downwardly extending prongs 88 which are engageable by flanges 90 and 92 on the wing nut. The wing nut is recessed at 94 to house part of the coil spring. The wing nut 46 is screwed up stud 44 causing the coil spring 84 to be compressed against washer 82, the washer 82 to be forced by the spring against platform surface 80, and the machine 14 to be pulled downwardly against platform upper surface 48 at rubber pads 96 by stud 42 acting through head end 54 on frame 50. The upwardly extending prongs 86 on washer 82 are caused to dig into the platform (normally of wood) by reason of the pressure exerted thereon by spring 84, and the washer is thereby prevented from turning. The nut can be turned further to increase the downward force on the machine frame 50 until the spring 84 has been compressed a predetermined amount sufficient to cause flanges 90 and 92 on the wing nut to engage the downwardly extending prongs 88 of the washer, whereupon the wing nut can no longer be turned. The maximum force which can be exerted on the frame 50 of machine 14 is thereby limited to a value determined by the spring constant of coil spring 84 which is suitably selected to prevent damage to frame 50 and yet assure that adequate force is provided to secure the machine to platform 12. A fused locking element 98 as shown, may be provided on the threaded portion 78 of stud 44 to render wing nut 46 self locking in the position of engagement with prongs 88. Once the wing nut 46 has been suitably tightened on stud 44, a fixed position for the sewing machine 14 on platform 12 is assured both by reason of the downward force exerted on frame 50 causing the machine to bear against the platform at pads 96, and because of pins 68 and 70 which prevent any possible angular movement of the machine on the platform.

As illustrated, frame 50 of the machine is of a plastic material, and as such would be reinforced with plastic fibers. Such a plastic frame is preferable to a metallic frame because of cost and weight considerations, and the use thereof in a machine to be attached to a platform in a cabinet is rendered possible by reason of the construction described herein for securing the machine in a cabinet. A plastic frame tends to creep when stressed and the resulting distortion can prevent the proper operation of movable parts therein. However, with the hold down arrangement of the invention, the force applied to such a frame may be suitably controlled to prevent damage to the frame and assure a fixed position for the machine on a movable platform in a sewing cabinet.

While the present disclosure relates to a preferred embodiment of the invention, it is for purposes of illustration only and is not to be construed as a limitation of the invention. Numerous alterations and modifications of the structure herein disclosed will suggest themselves to those skilled in the art, and all such modifications and alterations which do not depart from the spirit and scope of the invention are intended to be included within the scope of the appended claims.

We claim:

1. In combination, a sewing machine including a frame with a depending threaded stud attached thereto; a platform with a top surface upon which the machine is supportable in a sewing machine cabinet; a second stud detachably secured to the first mentioned stud and extending through a hole in the platform, said second stud including a threaded portion which projects beyond the bottom surface of the platform; a wing nut on the threaded portion of the second stud; a coil spring on the second stud compressed by the wing nut; and a washer on the second stud forced against the bottom surface of the platform by the spring, the washer including upwardly extending prongs which dig into the platform to prevent the washer from turning, the washer also including downwardly extending prongs engageable with the wing nut for limiting the extent to which the wing nut can be tightened on the second stud as the wing nut is turned to affix the sewing machine to the platform.

2. The combination of claim 1 including means defining a location for the machine on the platform with the fixed depending stud is in alignment with the hole provided in the platform for the second stud.

3. The combination of claim 2 wherein the machine is prevented from turning on the platform by the locating means.

4. The combination of claim 3 wherein the frame of the machine is plastic.

5. The combination of claim 1 wherein the fixed depending stud extends into a recess formed in the bottom of the base of the machine, and the second stud is attached to the fixed stud in said recess.

6. The combination of claim 1 wherein the second stud includes a threaded socket, and the second stud is detachably connected to the fixed depending stud by screwing the threaded socket onto the fixed stud.

7. The combination of claim 6 wherein the fixed depending stud extends into a recess formed in the bottom of the base of the machine, and the threaded socket on the second stud is screwed onto the fixed stud in said recess.

* * * * *